US005513607A

United States Patent [19]

Döragrip et al.

[11] Patent Number: 5,513,607

[45] Date of Patent: May 7, 1996

[54] STARTING APPARATUS FOR AN INTERNAL COMBUSTION ENGINE

[75] Inventors: Fridolf A. G. Döragrip, Tenhult; Sven I. Johansson, Huskvarna, both of Sweden

[73] Assignee: Aktiebolaget Electrolux, Stockholm, Sweden

[21] Appl. No.: 517,107

[22] Filed: Aug. 18, 1995

[30] Foreign Application Priority Data

Sep. 2, 1994 [SE] Sweden ..... 9402919

[51] Int. Cl.[6] ..... F02N 3/02

[52] U.S. Cl. ..... 123/185.3; 74/7 C; 74/577 R; 192/42

[58] Field of Search ..... 123/185.2, 185.3, 123/185.4; 74/7 C, 575–578; 192/42

[56] References Cited

U.S. PATENT DOCUMENTS 3,127,884 4/1964 Rice ..... 123/185.3

5,063,812 11/1991 Mercier ..... 123/185.2

*Primary Examiner*—Andrew M. Dolinar

*Attorney, Agent, or Firm*—Pearne, Gordon, McCoy & Granger

[57] ABSTRACT

Starting device for an internal combustion engine including a rope pulley (10), a freewheel coupling having a driving coupling part on the pulley, and a driven coupling part on a flywheel of the engine. The driving coupling part includes a ratchet wheel (14) and the driven coupling part includes a movable pawl (18) adapted to engage the ratchet wheel. The ratchet wheel is frusto-conical and has its relatively smaller diameter end facing the flywheel. An outer leg of the pawl is angled to correspond to the taper or cone angle of the ratchet wheel.

3 Claims, 1 Drawing Sheet

STARTING APPARATUS FOR AN INTERNAL COMBUSTION ENGINE

BACKGROUND OF THE INVENTION

The present invention relates to a pull rope starting device for an internal combustion engine wherein the rope starting device includes a freewheel coupling having a driving coupling part formed as part of the rope pulley, and a driven coupling part attached to the flywheel of the engine.

In known starting devices of the aforementioned type the freewheel coupling comprises a cylindrical ratchet wheel and two pawls adapted to engage the ratchet wheel at diametrically opposite sides of the ratchet wheel. The pawls are pivotally attached to the flywheel of the engine and actuated by a resilient force in order to normally engage the ratchet wheel. When the engine has started, the pawls are acted upon by centrifugal forces created by rotation of the flywheel which counteracts the resilient force, thus releasing the pawls from engagement with the ratchet wheel.

To reduce manufacturing expense, the ratchet wheel and the pulley are preferably made from one piece of plastic material. However, in order to assemble the freewheel coupling which incorporates a cylindrical ratchet wheel, it is necessary to bevel the pawls. Beveling the pawls allows the pawls to be mounted around the ratchet wheel against the action of the mentioned resilient force. Unfortunately, beveling the pawls reduces the area of engagement between the pawls and the ratchet wheel. The reduced area of engagement between the pawls and the ratchet wheel has resulted in problems in manufacturing a pulley and ratchet wheel assembly from plastic material which is strong enough to obtain a starting device with the desired reliability and durability.

SUMMARY OF THE INVENTION

An object of the present invention is to provide a starting device in which the above described problems have been reduced or eliminated. According to the present invention, the starting device includes a frusto-conically shaped ratchet wheel, wherein a smaller diameter end of the ratchet wheel faces the flywheel. In further accordance with the present invention, a portion of the pawl that engages the ratchet wheel is bent at an angle so as to correspond to the cone-angle of the ratchet wheel.

The frusto-conical shape of the ratchet wheel provided by the present invention allows the ratchet and pawl coupling to be easily assembled by bringing the parts together axially. The pawls do not need to be provided with bevels that reduce the engagement area between the ratchet wheel and the pawls. Since maximum engagement of the ratchet wheel and the pawls is achieved by the starting device of the present invention, the result is a more even distribution of the loading on the teeth of the ratchet wheel. As a consequence, an improved strength of the ratchet wheel is obtained, which results in an extended service life and an improved reliability of the starting device.

BRIEF DESCRIPTION OF THE DRAWINGS

The invention will be described herein with reference to the following description and drawings, wherein.

DETAILED DESCRIPTION OF THE PREFERRED EMBODIMENT

Figure 1:
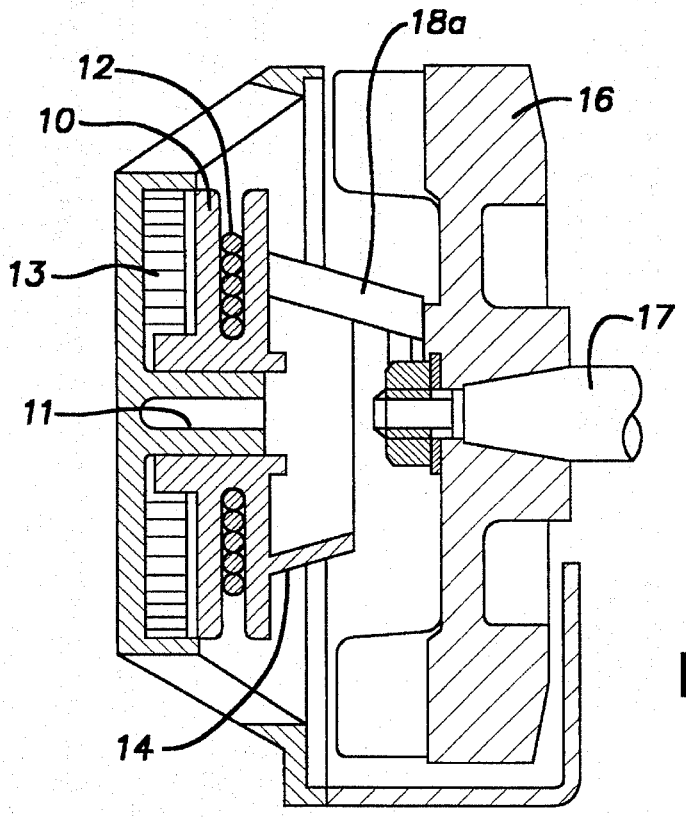
FIG. 1 is a longitudinal cross-section of the starting device in accordance with the present invention.

Referring to FIG. 1, a starting device according to the present invention is shown to include a pulley 10 which is made of plastic material and is rotatably attached to a shaft 11. The pulley is rotated in a conventional manner by means of a pull rope 12 and a return or rewind spring 13. A ratchet wheel 14 is integrally formed with the pulley 10 and is provided with a plurality of teeth 15.

Figure 2:
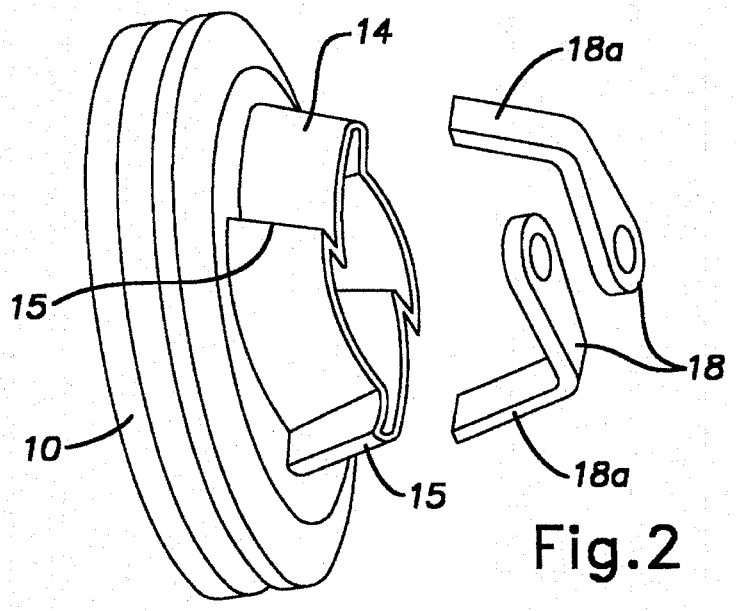
FIG. 2 is an exploded perspective view of a pulley and pawls shown in FIG. 1.

FIG. 1 also illustrates a flywheel 16 attached to a crankshaft 17 of an internal combustion engine (not shown). The flywheel has two pawls 18 which are rotatably attached at one of their ends to pins (not shown) provided at diametrically opposite positions of the flywheel. As shown best in FIG. 2, the pawls 18 are bent at an angle and provided with an outer leg **18*a* adapted to engage the teeth 15 of the ratchet wheel 14. The pawls 18 are actuated by a resilient force created by springs (not shown) in order to engage the ratchet wheel 14**.

The ratchet wheel 14 is generally frusto-conical in shape with a relatively smaller diameter end facing the flywheel 16. In the shown embodiment, the cone angle of the ratchet wheel 14 is about 30°. In order for the outer legs **18*a* of the pawls 18 to properly engage the ratchet wheel 14, the outer legs 18*a* are bent at an angle that corresponds to the cone angle of the ratchet wheel 14. Hence, each outer leg 18*a* defines an angle of about 15° with respect to the axis of rotation of the flywheel 16**.

The pawls 18 are resiliently actuated to normally engage the ratchet wheel 14, and allow the flywheel 16 to be rotated by the pull rope 12. When the engine starts and the rotational speed of the flywheel 16 increases, the pawls 18 are pivoted outwardly due to the centrifugal forces acting against the resilient force of the springs (not shown), to a position spaced outwardly from the ratchet wheel 14, whereby the engagement between the outer legs **18*a* and the ratchet teeth 15 is automatically discontinued, and the pawls 18 rotate freely around the ratchet wheel 14**.

Due to the frusto-conical shape of the ratchet wheel 14, the ratchet teeth 15 and pawl 18 coupling can be easily assembled by bringing the parts together axially, allowing the pawls 18 to be formed without bevels that would reduce the area of engagement between the teeth 15 and the pawls 18. As such, there is more even distribution of ratchet teeth 15 loading, resulting in an improved strength of the ratchet wheel 14, extending service life and improving reliability of the starting device.

Although the preferred embodiment of the present invention is described herein, it should be noted that the present invention is capable of various modifications and rearrangements without departing from the scope and spirit of the present invention. For example, the angle of the ratchet wheel and/or the pawls may be changed. Therefore, the scope of the present invention shall be only defined by the claims appended hereto.

What is claimed is:

1. Starting device for an internal combustion engine, comprising a rope pulley (10) having a pull rope (12), a freewheel coupling having a driving coupling part on said pulley and a driven coupling part on a flywheel (16) of the engine, said driving coupling part comprising a ratchet wheel (14) and said driven coupling part comprising a movable pawl (18) adapted to engage said ratchet wheel, wherein said ratchet wheel (14) is frusto-conically shaped and has its smaller-diameter end facing the flywheel (16), and a portion (**18*a*) of said pawl (18**) is angled to correspond to a cone angle of said ratchet wheel.

2. Starting device according to claim 1, wherein the cone angle of the ratchet wheel is 20°–40°.

3. Starting device according to claim 2, wherein the cone angle of the ratchet wheel is about 30°.

* * * * *